United States Patent [19]

Strella

[11] 4,056,706

[45] Nov. 1, 1977

[54] APPARATUS AND METHOD FOR EXTENDING FUSER RELEASE LIFE

[75] Inventor: Stephen Strella, Pittsford, N.Y.

[73] Assignee: Xerox Corporation, Stamford, Conn.

[21] Appl. No.: 569,735

[22] Filed: Apr. 21, 1975

[51] Int. Cl.[2] ..... H05B 1/00; G03G 15/00

[52] U.S. Cl. ..... 219/216; 219/388; 432/60; 432/228

[58] Field of Search ..... 219/216, 388, 469–471; 432/60, 228, 75

[56] References Cited

U.S. PATENT DOCUMENTS

| | | | |
|---|---|---|---|
| 3,811,821 | 5/1974 | Ariyama | 219/216 X |
| 3,861,861 | 1/1975 | Thetto | 432/59 |
| 3,878,818 | 4/1975 | Thetto | 432/75 X |
| 3,941,558 | 3/1976 | Takiguchi | 432/60 |
| 3,964,431 | 6/1976 | Namiki | 432/60 X |

*Primary Examiner*—C. L. Albritton

*Attorney, Agent, or Firm*—James J. Ralabate; Ernest F. Chapman

[57] ABSTRACT

A thermal fusing assembly having an extended release life is described. Offset preventing fluid depleted from elastomeric offset preventing material on fuser members is replaced by offset preventing fluid from fluid supply means comprising specified elastomeric materials having an inherent capacity for offset preventing fluid, the fluid supply means being journaled in contact with the fuser members. The thermal fusing assembly comprises a heated fuser member which contacts toner images electrostatically adhered to a support surface to soften a heat-softenable toner to affect bonding thereof to the substrate, the fuser member having an elastomeric outer coating of offset preventing material; a backup or pressure roll forming a nip with the fuser member to advance the support surface so that the toner image on the support surface contacts the fuser member; and an offset preventing fluid supply roll or belt comprising the specified elastomeric material having an inherent supply of offset preventing fluid, the fluid supply roll or belt being journaled or extended in parallel relation with the fuser member.

12 Claims, 4 Drawing Figures

APPARATUS AND METHOD FOR EXTENDING FUSER RELEASE LIFE

BACKGROUND OF THE INVENTION

This invention relates to heat fixing systems, and more particularly, to improvements in fuser apparatus and methods for fixing particulate material such as resinous toner particles, that are used in electrostatic copiers.

More specifically, the invention relates to an improved system and device for extending the release life of heated roll or belt fusing devices. Although the invention is considered to have general application, it is particularly useful in the field of xerography and has an important application in the fusing of resinous powder images produced by electrophotography or xerography onto substrate sheets, e.g., paper and the like, to which the powder images have been transferred after they have been formed by deposition of powder on an electrostatic latent image. Therefore, for convenience of illustration, the invention is described with reference to its use as a heat fuser for xerographic powdered images.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a substrate such as plain paper, with subsequent affixing of the image thereto.

In order to affix or fuse electroscopic toner material permanently onto a photosensitive member or other substrate by heat, it is often necessary to elevate the temperature of the toner material to a point at which the constituents of the toner material coalesce and become tacky. Thereafter, as the toner material cools, solidification of the toner material occurs causing the toner material to be firmly bonded to the support member or substrate. In both the xerographic as well as the electrographic recording arts, the use of thermal energy for fixing toner images onto a support member is a conventional and well-known technique.

One approach to thermal fusing of electroscopic toner images onto a support has been to pass the support with the toner images thereon between a pair of opposed roller members, at least one of which is either externally or internally heated. During operation of a fusing system of this type, the support member to which the toner images are electrostatically adhered, is moved through the nip formed between the rolls with the toner image contacting the fuser to affect thereby heating of the toner images within the nip. By controlling the heat transfer to the toner, virtually no offset of the toner particles from the copy sheet to fuser roll is experienced under normal conditions. This is because the heat applied to the surface of the roller is insufficient to raise the temperature of the toner whereat the toner particles in the image areas of the toner would liquify and cause a sheering action of the molten toner resulting in "hot offset." By the provision of the proper roll surface material, offset of toner particles is minimized Occasionally, however, toner particles will be offset to the fuser roll by an insufficient application of heat to the surface thereof, i.e., "cold offsetting," by imperfections in the properties of the entire surface of the roll; or by the toner particles insufficiently adhering to the copy sheet by the electrostatic forces which normally hold them there. In such a case, toner particles may be transferred to the surface of the fuser roll with subsequent transfer to the surface of the backup roll during periods of time when no substrate material is in the nip and before the backup roll can be moved out of contact with the fuser roll. Moreover, toner particles can be picked up by the fuser roll during fusing of duplex copies or simply from the surroundings of the reproducing apparatus.

To prevent such toner particles from being transferred to the copy substrate, it is necessary to remove the toner particles from the fuser roll. It will be appreciated that if enough toner accumulates on the fuser roll, the copy substrate, for example, paper, fed through the fusing system will be adversely effected.

One arrangement for minimizing the foregoing problems, including that which is commonly referred to as "offsetting," has been to provide a fuser roll with an outer surface or covering of polytetrafluoroethylene commonly known as Teflon, to which a release agent such as silicone oil, is applied. Silicone-based oils, which possess a relatively low surface energy, have been found to be a material that is suitable for use in the heated fuser roll environment. In practice, a thin layer of silicone oil is applied to the surface of the heated roll to form thereby an interface between the roll surface and the toner images carried on the support material. Thus, a low surface energy layer is presented to the toner as it passes through the fuser nip and thereby prevents toner from adhering or offsetting to the fuser roll surface.

Another arrangement for minimizing the "offsetting" problem is to provide a fuser member, for example, a fuser roll or belt structure, with an outer surface or layer of silicone rubber which due to its elastic properties during operation, prevents toner offset thereto. However, critical pressure means applying a meshing force between the heated member and the backup member must be used in this arrangement as disclosed in U.S. Pat. No. 3,666,247 where it is disclosed that it is not necessary for the heated member in contact with the powdered image to carry an offset preventing liquid on its surface when the pressure means for applying a meshing force between the members provides a pressure sufficiently high to cause the coating thereon to be in a compressed state about the powder image and to deform the second member so as to create a contact zone, the pressure being sufficiently low however, to avoid detrimental effects to the substrate. Tedious pressure adjustments required for this method are undesirable, and the manufacture and maintenance of such pressure equipment is costly.

While it may be desirable to avoid completely the employment of an offset preventing liquid upon the fuser surface, from the standpoint of overall cost of operation of apparatus employing a contact fuser, a fuser utilizing a conformable surface with silicone oil continuously applied thereto has been found to yield superior results in preventing toner offset accompanied by a considerable cost savings and very wide latitude in operation. Systems are known which apply silicone oil to a silicone rubber surface, however, many of these apply the silicone oil to the surface in an intermittent fashion which is suitable for only low volume and light density image applications. Other fusing systems and devices are known which continuously apply silicone oil or other offset preventing liquid to a silicone rubber surface or other release surface, however, such systems supply the offset preventing liquid or fluid from supply reservoirs which are designed to hold a supply of the liquid or fluid, or from fuser surfaces which provide a supply of lubricant to the surface thereof by capillary action and other phenomena. Examples of these fusing devices and techniques are found in U.S. Pat. No. 3,799,401 where lubricant is conveyed from a supply reservoir to an annular absorbent member and a roller in the dispensing reservoir partially immersed in the lubricant dispenses the lubricant from the reservoir to the absorbent member which in turn supplies the lubricant to the fuser member. Other wicking devices are disclosed in U.S. Pat. No. 3,718,116 and U.S. Pat. No. 3,745,972. In U.S. Pat. No. 3,268,351, a xerographic fixing method and apparatus is described wherein an offset preventing liquid, silicone oil, is supplied to one of two Teflon coated, heated members from a roll applicator partially immersed in a silicone oil bath or reservoir. Although these systems minimize "off setting", the constant application of the fluid requires a separate fluid reservoir and fluid applying means as well as metering and control to maintain the proper amount of fluid on the roll.

Another type of roll for pressure fusing electrostatic images at elevated temperatures comprises a fuser roll having a working surface of cured silicone rubber on the cylinder, the fuser roll coating itself having a silicone oil impregnated in the working surface. Offset preventing liquid, silicone oil, can be supplied to the surface of this roll as described in U.S. Pat. No. 3,731,358 in quantities relative to the thickness of the surface impregnated with the silicone oil. Thus, when the surface of the roll can be relatively thick, for example, when external sources of heating are used, the supply of silicone oil or other offset preventing liquid may be sufficient to fuse a substantial number of toned images upon substrates, however, when an internal heating system is utilized to provide the necessary heat at the surface of the fuser roll to fuse the toner image to the substrate material, very thin coatings of offset preventing material, for example, silicone rubber, are required to provide a minimal thermal barrier at the surface of the fuser roll or member. Thus, when such a thin working surface is available, inherently provided offset preventing liquid or silicone oil in the fuser member itself will provide only a limited release life of the fuser surface, making frequent replacement of the fuser roll necessary. Frequent replacement of such a fuser roll increases servicing of the equipment and thereby increases operating costs.

OBJECTS OF THE INVENTION

Accordingly, it is the principal object of this invention to provide a new and improved fuser apparatus and method of fusing toner images to a substrate.

Another object of this invention is to provide a new and improved fuser apparatus and method wherein an offset preventing fluid is continuously applied to an elastomeric surface.

Still another object of this invention is to provide a contact fuser apparatus and method for use in a xerographic reproducing machine wherein toner offsetting to the fuser roll or member is minimized.

Another object of this invention is to provide a contact fuser apparatus and method which not only extends the life of fuser members heated externally, but also substantially increases the release life of fuser members which are internally heated.

SUMMARY OF THE INVENTION

These and other objects of the invention are accomplished by a direct contact fusing assembly having at least three movable members, one member being a fuser member, one member being a backup or pressure roll and one member being an offset preventing fluid supply means comprising an elastomeric material having an inherent capacity for offset preventing fluid, the offset preventing fluid supply means contacting the fuser member. One or more such offset preventing fluid supply means may contact the fuser member in parallel relation.

In general, the thermal fusing assembly of the invention comprises a heated fuser roll which contacts toner images electrostatically adhered to a support surface or substrate to soften a heat-softenable toner to affect bonding thereof to the substrate, the fuser roll having an elastomeric coating of offset preventing material; a backup or pressure roll forming a nip with the fuser roll to advance the support surface so that the toner image on the support surface contacts the heated fuser roll; and an offset preventing fluid supply means (a roll or belt or both) comprising elastomeric material having an inherent capacity for offset preventing fluid, the fluid supply means being in contact with the fuser roll. Offset preventing fluid or liquid is transferred from the fluid supply means to the fuser roll to replace offset preventing liquid or fluid depleted from the coating of the fuser roll. In accordance with the present invention, offset preventing fluid depleted from conformable elastomeric offset preventing material on fuser rolls, is replaced by offset preventing fluid from fluid supply means comprising specified elastomeric materials having an inherent capacity for offset preventing fluid.

As used herein, elastomeric materials having an inherent capacity for offset preventing fluid, are those elastomeric materials which may be physically impregnated with the offset preventing fluid and thereby physically hold the offset preventing fluid therein; those elastomeric materials the nature of which inherently provides an offset preventing fluid by degradation or other reaction mechanism whereby the material of the member itself degrades or reacts to form upon its surface or within the elastomer an offset preventing fluid; and the like. Fluid supply means is any roll or belt capable of contacting a fuser roll and having such an elastomeric material at least upon its surface. As used herein, fuser member refers not only to fuser rolls but also to fuser belts and in most embodiments set forth herein "fuser roll" and "fuser belt" can be used interchangeably.

For a better understanding of the invention, as well as other objects and further features thereof, reference is had to the following detailed description of the invention to be read in connection with the accompanying drawings.

DESCRIPTION OF THE PREFERRED EMBODIMENTS

Figure 1:
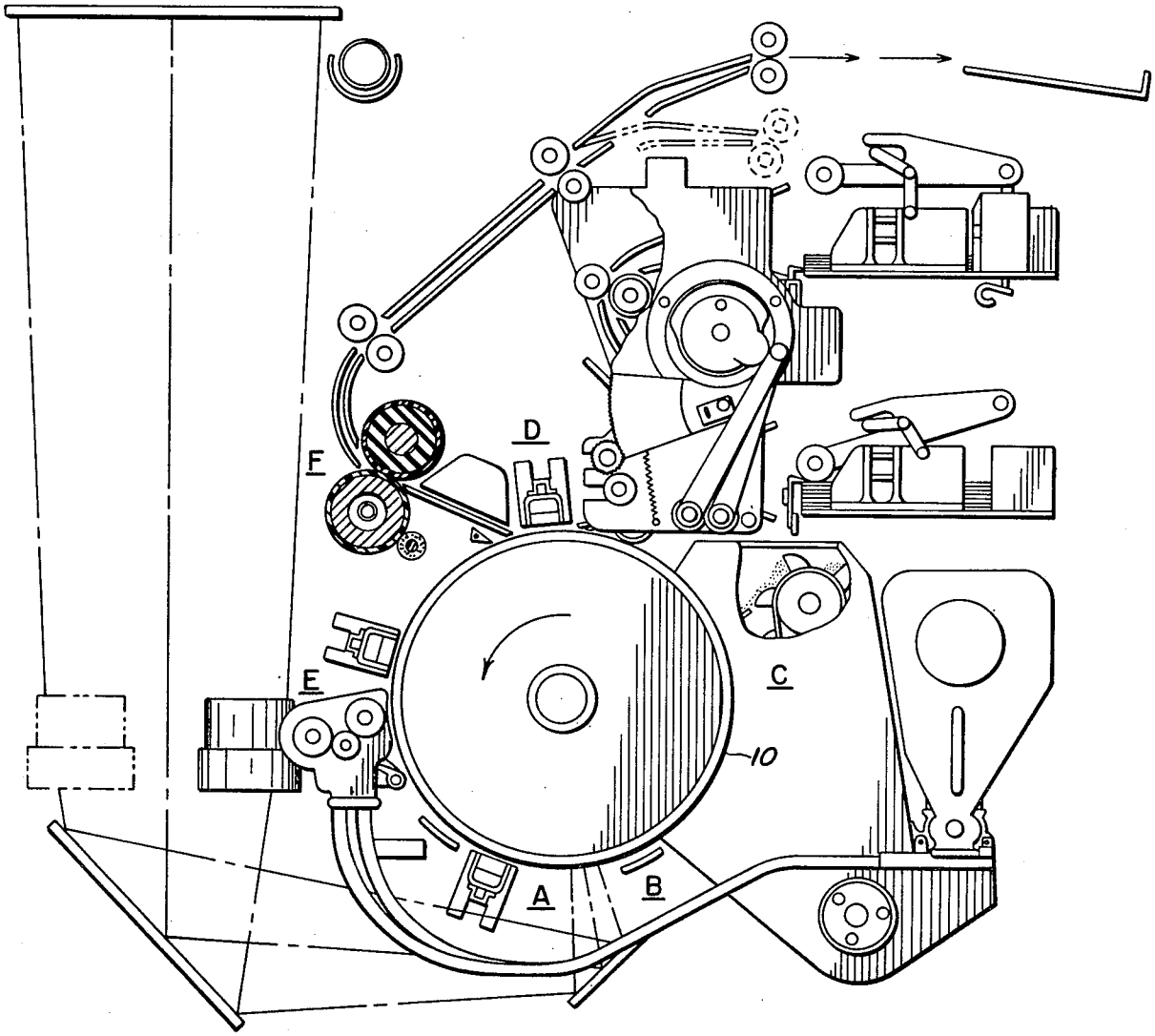
FIG. 1 is a schematic representation of an automatic xerographic reproducing machine incorporating the thermal fusing assembly having an extended release life of the present invention.

Referring to the drawing as shown in FIG. 1, an embodiment of the invention in a suitable environment such as an automatic xerographic reproducing machine is illustrated. The automatic xerographic reproducing machine includes a xerographic plate or surface 10 formed in the shape of a drum. The plate has a photoconductive layer or light sensitive surface on a conductive backing journaled in a frame to rotate in a direction indicated by the arrow. The rotation will cause the plate to sequentially pass a series of xerographic processing stations. For purposes of the present disclosure, the several xerographic processing stations in the path of movement of the plate surface may be described functionally as follows:

a charging station A at which the photoconductive plate is uniformly charged;

an exposure station B at which light or radiation patterns of originals to be reproduced are projected onto the plate surface to dissipate the uniform charge in accordance with the patterns to form thereby latent electrostatic images of the originals to be reproduced;

a developing station C at which xerographic developing material including toner particles having electrostatic charges opposite to that of the latent electrostatic images is cascaded over the latent electrostatic image to form toner or powder images in accordance with the original being reproduced;

a transfer station D at which the powder images are electrostatically transferred from the plate surface to a transfer material, such as paper, a thin polymeric sheet, a metallic surface, and the like, which is then passed through a heat pressure fusing system F according to the present invention as will be described hereinafter; and a drum cleaning and discharge station E at which the plate surface is brushed to remove residual toner particles remaining thereon after image transfer and at which the plate is exposed to a relatively bright light source to affect substantially complete discharge of any residual electrostatic charge remaining thereon.

For further details of the xerographic processing stations, reference may be had to U.S. Pat. No. 3,578,859, issued May 18, 1971 to W. K. Stillings.

Figure 3:
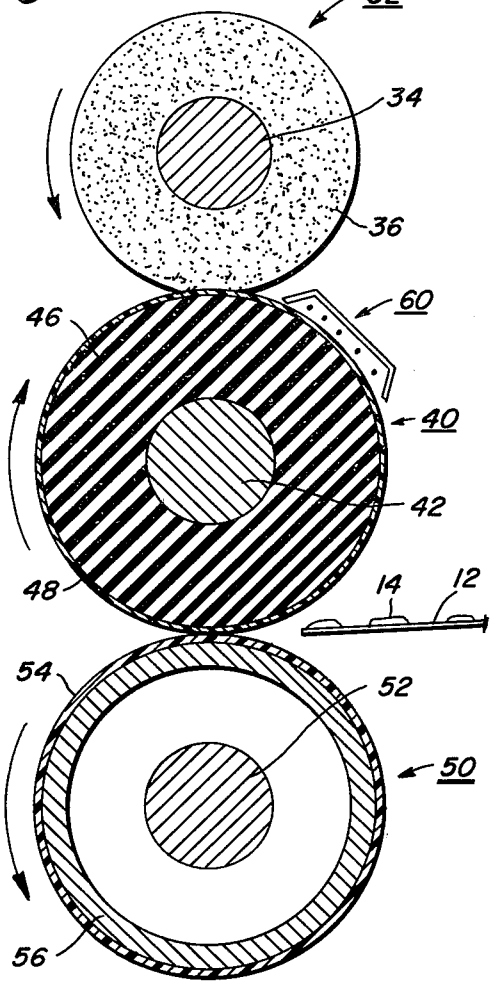
FIG. 3 is a side elevational view of a thermal, pressure fusing assembly wherein the fuser member has an external source of heat and the offset preventing supply means is a roll.
Figure 2:
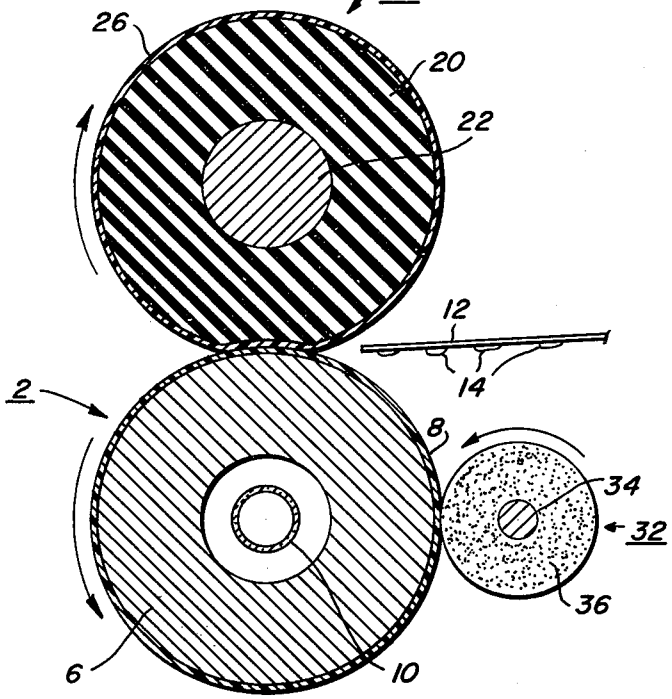
FIG. 2 is a side elevational view of a thermal, pressure fusing assembly with an internally heated fuser member and a supply roll.
Figure 4:
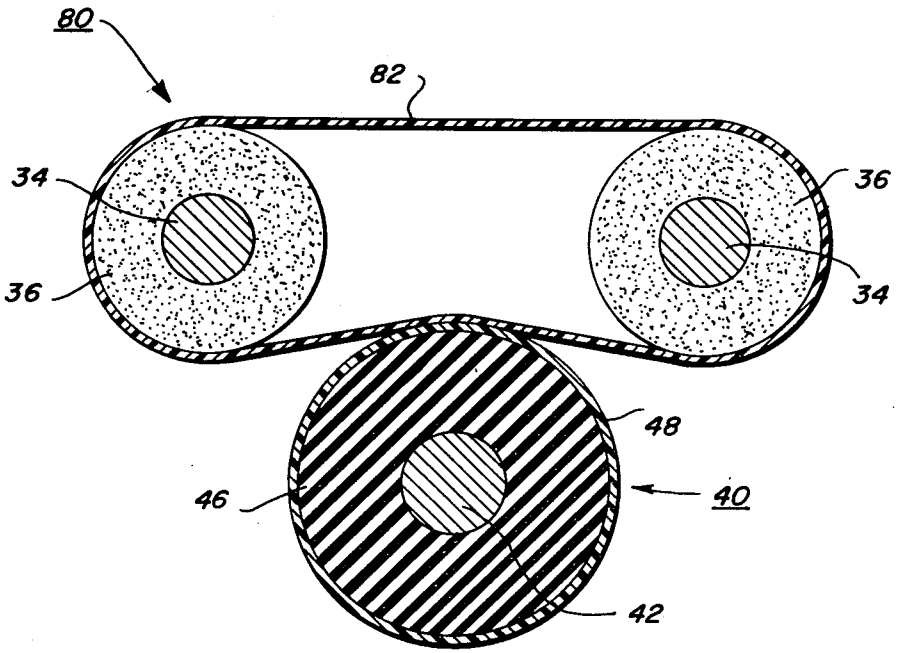
FIG. 4 is a side elevational view of a thermal, pressure fusing assembly having a belt offset preventing fluid supply means.

Details of the present invention showing an improved three-roll fuser assembly can be seen by referring to FIGS. 2–4. The drawings show preferred embodiments of the thermal fusing assembly having at least three movable members, three rolls in FIGS. 2 and 3 and two rolls and a belt in FIG. 4, including an offset preventing fluid supply means contacting the fuser roll. Critical in the device and in the operation of the fuser assembly is the elastomeric material coating the fuser roll and the elastomeric material covering at least the outer portion of the offset preventing fluid supply means. In accordance with the present invention the offset preventing fluid supply means must have an inherent capacity for the offset preventing liquid so that it can provide a continuous supply of offset preventing fluid at its surface for transfer to the fuser roll to replace offset preventing liquid depleted from the elastomeric coating on the fuser roll. The offset preventing fluid on the surface of the fuser roll is depleted when the support surface or support substrate having toner images electrostatically adhered thereto, contact the heated fuser roll. In the preferred embodiments, the offset preventing fluid on the fuser roll and within the fuser roll is replaced at a rate preferably equal to the rate of depletion from the fuser roll.

Referring to FIG. 2, there is shown a heated pressure fusing system which includes an internally heated fuser roll 2, a backup pressure roll 24 and an offset preventing fluid supply roll 32 for extending the release life of fuser roll 2. Fuser roll 2 is a hollow circular cylinder with a metallic core 6 and an offset preventing material layer 8 up to 20 mils (0.508 mm) in thickness. More specifically, offset preventing material layer 8 is an elastomeric material preferably having an inherent capacity for offset preventing fluid, and may include, for example, a layer of silicone rubber, a layer of silicone rubber impregnated with an offset preventing fluid such as silicone oil, an elastomeric material characterized by the property wherein the elastomeric material itself degrades or reacts (e.g., hydrolyzes) to form an offset preventing fluid and the like. A lamp 10, for example a quartz lamp, serves as a source of thermal energy and is located at the center of fuser roll 2. Power to the lamp is controlled by a thermal sensor generally called a thermistor (not shown) contacting the periphery of the fuser roll as described, for example in U.S. Pat. No. 3,357,249. Backup roll 24 is also a cylinder and is preferably made of metal core 22 surrounded by thick rubber layer 20 and also a layer of polymeric material 26, for example, Teflon, to prevent soaking of offset preventing fluid into rubber layer 20 and subsequent swelling thereof. In the embodiment shown in FIG. 2, pressure or backup roll 24 is a conformable roll.

As well known in the art, when the two rollers 24 and 2 are engaged as shown in FIG. 2, that is, when they are journaled in parallel relation with each other, the applied load deforms the rubber in pressure roll 24 to provide the nip with a finite width. Support surface or copy sheet 12, for example, paper, thin polymeric film, metal and the like, electrostatically bearing the toner or powder images 14 is brought into contact with the nip of the rolls with the toner image contacting the surface of fuser roll 2. For a given temperature of the fuser roll, the fusing rate will depend upon the contact arc length of the support material against the dwell time, i.e., the time the toner images remain between the fuser roll 2 and the backup roll 24. Dwell time can be varied either by changing the surface velocity of the rolls or by varying the contact arc length and holding the speed of the roll the same. Contact arc length depends on the softness of the rubber on backup or pressure roll 24 and on the amount of pressure between rolls 2 and 24. The mechanism for driving rolls and/or belts and for lowering and raising rolls and/or belts into contact in accordance with the present invention can be accomplished by any suitable means as that described, for example, in U.S. Pat. No. 3,291,466 or by a suitable mechanical camming device or any other device well known to those skilled in the art.

As a sheet of substrate material is advanced between rolls 2 and 24, toner images 14 on support material 12 will contact the peripheral heated surface of roll 2 whereby the toner images become tackified and in this tackified condition, the toner will tend to offset on fuser roll 2 except that it is partially prevented from doing so by the offset preventing material 8 coating the surface of fuser roll 2. However, this may be prevented for a short period of time by providing an elastomeric material 8 on fuser roll 2, which provides a thin film of offset preventing liquid or fluid, such as silicone oil, on the surface of elastomeric offse preventing material 8. However, in those cases where offset preventing material 8 has no inherent capacity for providing offset preventing fluid or liquid at the surface of layer 8, and for those cases wherein offset preventing material 8 on fuser roll 2 comprises a material having an inherent capacity for providing offset preventing fluid at surface 8, and such offset preventing fluid inherently provided at surfaces 8 becomes depleted, it is by the offset preventing fluid supply roll 32 of the present invention which applies offset preventing liquid to and/or replaces offset preventing liquid depleted from the coating of the fuser roll 2 such that toner offset is prevented or such that the release life of the offset preventing material is extended.

Offset preventing fluid supply roll 32 comprises a roll or cylinder or elastomeric material having an inherent capacity for providing offset preventing fluid at the surface of supply roll 32. In FIG. 2, offset preventing fluid supply roll 32 comprises a shaft, preferably a metal shaft 34, and an outer coating of elastomeric material 36 having an inherent capacity for providing offset preventing fluid. Elastomeric material 36 may be a material mechanically or physically impregnated with an offset preventing fluid or liquid, or it may be a suitable polymeric material which degrades or decomposes or reacts to form by a reaction mechanism, a fluid which is suitable as an offset preventing liquid, or it may be any other type of suitable material which continuously and inherently provides during operation a supply of offset preventing liquid upon its surface suitable for transfer to fuser roll 2 and suitable for preventing off-setting of toner or powder 14 upon offset preventing material 8.

Examples of materials which inherently degrade or react to form an offset preventing liquid or fluid are described in copending U.S. Pat. application, Ser. Nos. 497,409, 497,411 and 497,410 all fined on Aug. 14, 1974 and assigned to the instant assignee. Suitable materials for use in the offset preventing fluid supply roll of the instant invention are also described in U.S. Pat. No. 3,731,358 issued May 8, 1973. In such instances, rolls are described which have an outer layer of elastomeric material which provides at the surface thereof from within itself, a release material for the prevention of offsetting or sticking of the toner to the roll as the roll rotates in contact with the toner. Exemplary of the materials therein, the outer layer of elastomeric material is an elastomeric silicone compound commonly referred to as silicone rubber. The working surface of the cured silicone rubber 36 in supply roll 32 in this particular preferred embodiment consists essentially of a silicone oil impregnating the working surface. The silicone oil may be any suitable dialkyl polysiloxane, such as dimethylpolysiloxane, an alkyl phenyl polysiloxane, such as methylphenylpolysiloxane or any of several other materials well known in the art.

Examples of the elastomeric material 36 on supply roll 32 which form a suitable offset preventing liquid or fluid in accordance with the present invention by means of a degradation or other type of reaction of the elastomeric material itself are described in the above-referenced copending patent applications assigned to the instant assignee and filed on Aug. 14, 1974, said references being incorporated herein by reference for describing and setting forth more clearly the materials which may be used to provide offset preventing liquid or fluid in accordance with the instant invention. Therein are described silicone rubbers having dispersed therein a catalytic agent which in the presence of water or moisture, promotes the degradation of the silicone rubber over a period of time at elevated temperatures to provide a release liquid or fluid which is the degradation product of the silicone rubber. Such a catalytic agent may be, for example, benzoic acid, and examples of silicone rubber include polymethylphenylsiloxane, polydialkylsiloxane, polymethylvinylsiloxane and the like. Examples of other materials which may be utilized as elastomer material 36 in supply roll 32 include silicone rubbers having dispersed therein agents capable of supplying water over a period of time at elevated temperatures to promote the degradation of the silicone rubber to form a release liquid or fluid which is the degradation product of the silicone rubber resulting from the hydrolysis of the silicone rubber. Typical agents which cause the degradation of the silicone rubber are, for example, hydrated starch, hydrated minerals, colloidal silica gel and the like, and examples of the silcione rubbers which respond to the hydrolysis action are the same as those described supra. Other examples of elastomeric materials which degrade to form release fluids or liquids and which are useful in accordance with the present invention may be chosen as materials for offset preventing fluid supply roll 32 by one skilled in the art.

In general, elastomer 36 in offset preventing fluid supply roll 32 are materials used in conjunction with fluids which are miscible with the particular elastomer. Thus, it is preferred that the elastomers used in supply roll 32 comprise those which are compatible with the particular offset preventing fluid used on fuser roll 2. The offset preventing fluid or liquid should be the type which will swell the elastomeric material but which is thermally stable and prevents offset upon fuser roll 2. Porous and reticulated elastomeric materials which swell or hold in some other manner a fluid which will be operable as an offset preventing liquid, may be used in accordance with the present invention. The most preferred systems are those having a silicone rubber material impregnated with any of the well-known silicone oils or fluids which prevent offset of toner upon conventional rolls. Other systems include ethylene-propylene rubbers having mineral oils impregnated therein.

In general, the class of offset preventing liquids or fluids which have been found most useful in the present invention include those which are non-degradable, those which may be impregnated into the elastomeric surfaces and materials used in rollers, those which swell the elastomer but do not degrade it, and those wherein the surface tension of the fluid or liquid is less than the surface tension of the toner material.

Offset preventing fluid supply roll 32 is journaled in parallel relation with fuser roll 2 and is preferably moved upon its axis by a suitable driving device, for example, a motor (not shown) or by its frictional contact with fuser roll 2. A plurality of supply rolls and/or belts can be provided if desired. One skilled in the art can choose suitable mechanisms for engaging and driving said rolls.

The invention is not limited to the particular site of engagement between roll 32, roll 2 and roll 24. The particular rolls may be located in those areas which best serve the location of the rolls in the machine and which promote ease of alignment, service, operation, and the like. The contact arc between roll 32 and roll 2 as well as the contact arc between roll 24 and roll 2 may be adjusted by one skilled in the art, the contact arc between roll 32 and roll 2 being adjusted to allow sufficient diffusion of oil from supply roll 32 to fuser roll 2. Proper choice of rubber durometer, oil viscosity and the like may be manipulated by one skilled in the art to match the replenishing or replacement rate of the offset preventing fluid depletion, for example, by copy throughput, in the fuser roll coating. Other variables such as hardness of materials, thermal conductivity, roll pressures, roll speeds, and heat input may also be balanced in a manner to provide the most effective fusing operation and may be adjusted by one skilled in the art. Furthermore, the release life of fuser belt members as described in U.S. Pat. No. 3,810,735 may be extended in accordance with the present invention.

In preferred embodiments, the diameter of offset preventing liquid supply roll 32 is greater than one inch on a one-half inch metal shaft and most preferably comprises an outside diameter of about 1 to about 3 inches. The rolls and/or belts are driven in synchronization by means of a drive shaft (not shown) adapted to be connected to a separate drive mechanism or to the copy substrate or paper drive mechanism, such as a motor (not shown), whereby the rolls and/or belts are maintained in intimate contact with each other. One skilled in the art can provide a suitable frame, support means, end plates, drive shafts, gears, and journaled drive means by teachings well known in the art, for example, from the teachings of U.S. Pat. No. 3,268,351 and U.S. Pat. No. 3,498,596.

Referring to FIG. 3, there is shown an alternative embodiment of the instant invention wherein the fuser roll is heated by external means such as a heat lamp or other device commonly or conventionally used in the art. The fuser apparatus of FIG. 3 is of the pressure-roller heat type and includes a frame (not shown) for supporting at least three rollers. Suitable frames, heating elements, drive mechanisms and the like can be provided by one skilled in the art, for example, from the teachings found in U.S. Pat. No. 3,498,596.

As in the embodiment shown in FIG. 2, in FIG. 3 direct contact fusing of a powder image 14 on a sheet of paper support material 12 is achieved by forwarding sheet 12 bearing the powder image 14 to be fused between heated fuser roller 40 rotating into and under pressure during a fusing operation with a backup or pressure roller 50. Support material 12 carrying unfused toner 14 may be directed between the nip of rollers 40 and 50 by suitable guide rods or rollers, (not shown) in conjunction with the transport system of the copying device.

In accordance with the present invention, the externally heated fuser roll may comprise a resilient elastomeric offset preventing material surrounding or mounted upon a shaft. This resislient elastomeric material has been described supra in regard to coating material 8 on fuser roll 2 in FIG. 2. The shaft may be any suitable metal or the like or may be a metallic cylinder. In accordance with the present invention the rollers are preferably closed at both ends by caps (not shown) and made of heat insulating materials. Each of the caps in turn may be secured upon the shaft which supports the roller for rotation within the fuser assembly. The ends of the shaft are preferably rotatably mounted by bearings upon end plates (not shown). Preferred elastomeric offset preventing materials for the fuser rolls of FIG. 3 have been described supra and are preferably of the type wherein the elastomeric material has an inherent capacity for offset preventing fluid which is provided at the surface of the fuser roll for preventing offset of the toner image upon the fuser roll. The characteristics and functions of this outer surface of the fuser roll have been described above and preferred embodiments have been discussed in detail in regard to the fuser roll shown in FIG. 2.

In FIG. 3, fuser roll 40 has heat applied thereto externally by means of quartz lamp 60 suitably mounted in the fuser frame (not shown) along the length of the fuser roll so that its axis is generally parallel thereto. Lamp 60 is surrounded by a suitable reflector which also extends for the length of the fuser roll. Suitable mounting means for the lamp and the reflector may be provided by one skilled in the art. The heat lamp 60 is preferably suitably positioned toward or away from the fuser roll 40 in accordance with the amount of heat to be imparted to an unfused toner image on a support medium such as paper, being transported between fuser roll 40 and backup or pressure roll 50. Details of suitable external heating means, are set forth in U.S. Pat. No. 3,498,596. Although the fuser roll shown in the embodiment of FIG. 3 comprises an elastomeric offset preventing material surrounding a suitable shaft, other elements may also be included in the fuser roll as long as such elements do not interfere with the ability of the offset preventing material to release tackified toner during the fusing operation and as long as such elements do not interfere with the ability of the external heating means to heat the roller sufficiently to tackify or fuse the toner material on the copy substrate.

In the specific embodiments shown in FIG. 3, the fuser roll 40 comprises a metal shaft 42 surrounded by a layer of silicone rubber 46 which acts as a resilient blanket material further coated with a silicone oil impregnated silicone rubber material 48 otherwise described as an elastomeric offset preventing material impregnated with a silicone oil. However, when elastomeric layer 46 is a suitable offset preventing material capable of providing an offset preventing fluid upon its surface, elastomer layer 48 may be eliminated. Since an external source of heat, 60, is provided in this embodiment, the thickness of the elastomeric offset preventing layer on fuser roll 40 is not critical.

The backup or pressure roll 50 may be any suitable roll for providing the pressure necessary to pass the support material bearing the toner image through a nip formed with fuser roll 40. For example, as shown in FIG. 3, it may comprise a metallic cylinder 56 supported upon metal shaft 52 by means of suitable caps (not shown) secured to shaft 52 and to the interior surface of each end of the roller. A coating of insulating abhesive material such as Teflon designated by numeral 54, may be used on the outer surface of cylinder 56 (e.g., a metal cylinder) and may be of a sufficient hardness to provide indentation of the elastomeric material on the fuser roll 40 when in pressure contact therewith. The shaft may be mounted and driven by any of the suitable means discussed above.

In accordance with the embodiment shown in FIG. 3 and in accordance with the present invention, at least one roll for supplying offset preventing liquid o r fluid to the surface of the fuser roll to replace offset preventing fluid depleted from the elastomeric surface of the fuser roll must be used in the present invention. This offset preventing fluid supply roll is shown generally by numeral 32 in FIG. 3 where numeral 36 represents an elastomeric material having an inherent capacity for offset preventing fluid mounted upon a suitable metallic shaft 34. The offset preventing fluid supply roll for extending the release life of the fuser roll 40 is preferably moved snychronously with fuser roll 40 so that sufficient offset preventing fluid or liquid may be transferred from roll 32 to fuser roll 40 to replace offset preventi ng liquid depleted from the coating or outer layer of fuser roll 40.

In accordance with the instant invention, it is critical that offset preventing fluid supply roll 32 comprise elastomeric material 36 capable of providing an inherent supply of offset preventing fluid upon its outer surface. This type of offset preventing fluid supply roll applies offset preventing liquid, for example, silicone oil, evenly and at a constant rate for an extended period of time without the need of saturated felt pads, and without the need of the applicator roll extending into a reservoir for a supply of offset preventing liquid as described in U.S. Pat. No. 3,268,351. The fluid supply roll having an inherent capacity for providing offset preventing fluid to the fuser roll also eliminates the necessity of wipers and doctor members to continuously control the amount of offset preventing liquid transferred to fuser roll 40.

Although the embodiments described herein have shown only one offset preventing fluid supply roll, it is deemed to be within the purview of one skilled in the art to provide more than one offset preventing fluid supply roll and to provide means for engaging and disengaging such rolls from the fuser roll surface as desired.

Referring to FIG. 4, there is shown an alternative embodiment wherein the release life is extended by means of an offset preventing fluid supply belt used in conjunction with at least two offset preventing fluid supply belt used in conjunction with at least two offset preventing fluid supply rolls upon which the offset preventing fluid supply belt is guided. In FIG. 4, the specific embodiment is directed to supplying offset preventing fluid to the offset preventing elastomer coating upon the surface of fuser member 40. However, the applicator means for replacing offset preventing fluid or liquid depleted from the fuser roll wherein the applicator means is in the form of an applicator belt as in FIG. 4, may also be used with the particular fuser means described in FIG. 2 and designated therein by numeral 2. In FIG. 4, only enough of the offset preventing fluid applicator belt means 80 is shown to illustrate the belt applicator system. A pressure or backup roll can be provided as desired.

The offset preventing fluid supply belt system works substantially in the same manner as the offset preventing fluid supply rolls described supra. Belt 82 may be made of a material capable of carrying offset preventing liquid or fluid from elastomeric material 36 to elastomer 48 on fuser roll 40, or it may be a material having an inherent capacity for offset preventing fluid. Exemplary of materials for belt 82 are reticulated silicone foam rubbers well known in the art, certain felt-based materials, other reticulated elastomeric materials, and the like. As belt 82 driven by rollers 36 passes over the surface of rollers 36, belt 82 picks up oil upon its back surface thereby providing a supply of offset preventing fluid to belt 82. The offset preventing fluid then passes from the rear surface of belt 82 to the outer surface of belt 82 where it is available for transfer to elastomeric offset preventing material 48 of fuser roll 40. In this manner, the offset preventing fluid depleted from the surface of offset preventing material 48 of fuser roll 40 is replenished as the offset preventing fluid is depleted therefrofm during operation. When belt 82 has an inherent capacity for providing offset prevention fluid, rollers 36 in FIG. 4 may be of the type which do not inherently provide offset preventing fluid. It is to be understood, however, that at least one member of supply means 80 must comprise a roll or belt having an inherent capacity to supply offset preventing fluid, and may also comprise an offset prevention supply roll (not shown) contacting the outer surface of belt 82.

In choosing a suitable combination of offset preventing fluid and offset preventing material for the fuser roll surface, the offset preventing material is preferably an elastomer which permits the diffusion of the offset preventing fluid therethrough and is described as the interaction of offset preventing material with offset preventing fluid. In the case of silicone rubber-silicone oil combinations, it is referred to as the interaction of silicone rubber with silicone oil. This interaction is well known by those skilled in the art and proper elastomer/offset preventing fluid combinations can be easily chosen by one skilled in the art without undue experimentation. In accordance with the present invention, the offset preventing material/offset preventing fluid combination is sufficient as long as a layer of offset preventing liquid such as silicone oil, is present on the surface of the fuser roll to prevent offset of toner material. This layer of offset preventing liquid is removed by the fused copy, and is replenished by diffusion of oil to the surface of the fuser roll from an offset preventing fluid supply inherent in the surface material of the fusr roll. In accordance with the present invention, the offset preventing fluid supplied to the surface of the fuser roll from the inherent supply found in the fuser roll surface is replenished by the offset preventing liquid supply roll or belt having an inherent capacity for providing offset preventing liquid upon its surface for transfer to the surface of the fuser member.

Following are typical examples of offset preventing materials and offset preventing fluids which may be used in accordance with the present invention. The information is meant to be exemplary only and is not meant to limit the scope of the invention.

EXAMPLE I

A three-inch roll containing a two-inch (5.08 cm) outer layer of silicone rubber material supplied by Dow Corning under the tradename Silastic S2393 was soaked in 350 CS silicone fluid supplied by Dow Corning Corporation under the trade designation "200" until about 10 percent by weight of the silicone oil had soaked into the silicone rubber material. This was then installed in a fixture similar to that described in FIG. 2 and run in a standby mode while contacting a fuser roll coated with about 8–12 mils (0.20 – 0.31 mm) of the same silicone rubber material from which the silicone oil had been depleted. After a five hour period of operation, six grams of silicone oil had transferred from the oil-soaked roll (offset preventing fluid supply roll) to the oil depleted surface of the fuser roll. The nip between the two rolls was 0.05 inch (0.127 mm).

EXAMPLE II

A fuser assembly similar to that described in FIG. 2 was provided and a three-inch (7.62 cm) outside diameter silicone oil-filled roll as described in Example I was used to contact the fuser roll surface with a nip of 0.05 inch (0.127 mm). The fuser roll surface was an oil-depleted material at the beginning of the experiment. After passing 500 copies of a paper substrate through the nip formed by the backup or pressure roll and the fuser roll, the fuser roll coating, as described in Example I, was found to contain 1 percent silicone oil, and the oil depletion rate from the fuser roll was found to be 0.3 microliter per copy.

By calculating the back diffusion rate using the equation well known in the art, the above-described fuser assembly can provide a release life for conventional toner images on paper substrates at up to about 450° F for 500,000 copies. Larger or higher oil contents in the offset preventing fluid supply roll would yield even longer lifetimes.

EXAMPLE III

Using a conventional internally heated fuser apparatus as described in FIG. 2 without the third roll, the offset preventing fluid supply roll, and three different fuser rolls having different thicknesses of silicone rubber as a low surface energy elastomer (offset preventing material) supplied by General Electric Company under the trade designation GE RTV 112 soaked in silicone oil so that the outer layer on the fuser roll, i.e., the silicone rubber coating, has an oil content of 50 percent (by weight), a 10 mil (0.254 mm) thick coating of silicone rubber of the type described on the surface of the fuser roll is sufficient to fuse about 30,000 copies upon a paper substrate.

EXAMPLE IV

A fuser assembly was set up in accordance with that described in Example IV wherein the surface coating of the fuser roll was about 8–12 mils (0.20 – 0.31 mm) in thickness with a conventional pressure roll as shown in FIG. 2 and an internal heating device as shown in FIG. 2. In addition to the 2-roll fuser assembly, there was added a third roll having a one-inch diameter metallic core covered with a one-half inch thick layer of a composition comprising, prior to curing, a silicone gum supplied by Dow Corning Corporation under the trade designation X4-2589U (50.0 grams), 5.0 grams of a conventional colloidal silica filler supplied by Cabot Corporation under the trade designation CAB-O-SIL MS-5, 250.0 grams of toluene and 0.05 gram conventional vulcanizing agent supplied by Hercules, Inc., under the trade designation Di-Cup R. This coating properly cured, by means conventionally known in the art, was soaked in conventional silicone fuser oil until the roll had an oil content of 20 percent (by weight). At an oil depletion rate of 0.1 microliter per copy, sufficient for good release for conventional thermoplastic resin toners at up to about 450° F, an additional 500,000 copies is obtained by using the silicone oil-impregnated third roll (supply roll).

The objects of the present invention have been amply demonstrated by the examples and data set forth above. Excellent release life of fuser rolls and fuser belts is possible by using the three-member or three-roll fuser assembly wherein the third member or roll comprises a coating of elastomeric material having an inherent supply of offset preventing fluid therein capable of being continuously released during operation of the fuser assembly so that the offset preventing material coating the fuser roll or member and depleted therefrom is continuously replenished during operation. Such offset preventing supply rolls or belts can be provided by impregnating elastomeric materials with an offset preventing fluid compatible therewith.

While this invention has been disclosed with reference to the methods and compositions disclosed herein, it is not necessarily confined to the details as set forth, and this application is intended to cover such modifications or changes as may come within the scope of the following claims.

What is claimed is:

1. A fusing assembly for use in a xerographic reproducing apparatus for fixing a powder image onto a support surface comprising, a frame;

a first and second member journaled in parallel relation to a third member in said frame, the third member being a fuser member comprising an elastomer impregnated with an offset prevention fluid, the first member being a pressure member to cause the support surface to advance between the fuser member and the pressure member, and the second member being an offset prevention liquid supply member comprising an elastomer material capable of degrading to a fluid having offset prevention properties and providing upon its surface an offset prevention fluid for transfer to the fuser member for restoration of depleted offset prevention fluid in the fuser member; and means to heat at least the surface of the fuser member;

the fuser member being heated sufficiently and contacting the support surface carrying the powder image with sufficient pressure whereby the powder image is fused to the support surface as the support surface advances between the pressure member and the fuser member, the second member contacting the fuser member with sufficient pressure whereby the offset prevention fluid therein transfers from the elastomer material of the second member to the elastomer material of the fuser member and thereby replenishes release material depleted from the fuser member.

2. The fuser assembly of claim 1 wherein the elastomer material comprises a silicone rubber capable of hydrolyzing to a silicone oil in the presence of moisture.

3. A fuser device for use in a xerographic reproducing apparatus for fixing a powder image onto a support surface comprising a support means; a pressure roll and a fuser member journaled in parallel relation to each other in the support means whereby a support surface carrying the powder image intimately contacts the fuser member, the fuser member having at least a coating of conformable offset preventing material impregnated with an offset preventing liquid on its peripheral surface;

an offset prevention liquid supply belt means comprising an elastomer material capable of inherently providing upon its surface an offset preventing liquid, said belt means contacting the fuser member in parallel relation whereby offset preventing liquid in the belt means is applied to the fuser member surface to replace offset preventing liquid depleted from the offset preventing material of the fuser member;

means to heat the fuser member to a temperature sufficient to tackify the powder of the powder image; and means to move the support surface through the fuser member and the pressure roll with the powder image in contact with the fuser member;

the fuser member being heated sufficiently and contacting the support surface with sufficient pressure to fuse the powder image to the support surface.

4. The fuser device of claim 3 wherein the belt comprises an elastomer material capable of being impregnated with an offset prevention fluid.

5. The fuser device of claim 3 wherein the belt comprises an elastomer material capable of degrading to a fluid having offset prevention properties.

6. A fuser device for use in a xerographic apparatus for fixing a powder image onto a support surface comprising a support means;

a pair of rolls including a pressure roll and a fuser roll journaled in parallel relation to each other in the support means whereby a support surface carrying the powder image intimately contacts the fuser roll, the fuser roll having at least a coating of conformable offset preventing material impregnated with an offset preventing liquid on its peripheral surface;

an offset prevention liquid supply belt means contacting the fuser roll in parallel relation, said belt comprising a material capable of carrying an offset preventing liquid whereby offset preventing liquid in the belt means is applied to the fuser roll surface to replace offset preventing liquid depleted from the offset preventing material of the fuser roll;

roll means comprising an elastomer material capable of inherently providing upon its surface an offset prevention fluid, said roll means contacting the belt means whereby offset preventing liquid in the roll means is applied to the belt means and subsequently transferred from said belt means to the fuser roll surface to replace offset preventing liquid depleted from the offset preventing material of the fuser roll; and means to heat the fuser roll to a temperature sufficient to tackify the powder of the powder image; the fuser roll being heated sufficiently and contacting the support surface with sufficient pressure to fuse the powder image to the support surface.

7. The fuser device of claim 6 wherein the offset preventing liquid supply means provides offset preventing liquid to the surface of said belt means.

8. The fuser device of claim 6 wherein the offset preventing liquid supply roll contacts the inner surface of the belt means, the offset preventing liquid thereby impregnating said belt means and thereby providing offset preventing liquid upon the surface of said belt means in contact with the fuser roll surface.

9. The fuser device of claim 6 comprising a plurality of offset preventing liquid supply rolls in contact with the outer surface of said belt means.

10. The fuser device of claim 6 comprising a plurality of offset preventing liquid supply rolls in contact with the inner surface of said belt means.

11. The fuser device of claim 6 comprising at least one offset preventing liquid supply roll in contact with the inner surface of said belt means and at least one offset prevention liquid supply roll in contact with the outer surface of said belt means.

12. In the method of fixing a powder image on a support material, comprising: heating one of a pair of pressure members that are rotating in material feeding relation and of which the heated member is provided with an offset preventing surface capable of being impregnated with an offset preventing liquid which is miscible with the offset preventing material of the surface that is heated, to a temperature sufficient to tackify the powder of the powder image; moving the support material to a position to be gripped and advanced by the pressure members in a manner to place the surface of the support material bearing the powder image in contact with the heated member, forcing the support material into intimate contact with the heated member with sufficient pressure to insure good thermal contact between the support material surface and the heated member and thereby heating the powder image to a temperature sufficient to tackify the powder, and removing the support material out of contact with the pressure members after the powder image is tackified, the improvement comprising:

transferring offset preventing liquid from an advancing elastomeric belt having an inherent capacity for providing upon its surface an offset preventing fluid, the offset preventing liquid and the elastomeric material being miscible, to the advancing heated member to replenish offset preventing liquid depleted from the offset preventing material on the heated member surface.

* * * * *